US010329695B2

(12) United States Patent
Bircher

(10) Patent No.: US 10,329,695 B2
(45) Date of Patent: Jun. 25, 2019

(54) WEBBING WITH CONCEALED EDGES

(71) Applicant: MMI Textiles, Inc., Westlake, OH (US)

(72) Inventor: Amy Bircher, Rocky River, OH (US)

(73) Assignee: MMI TEXTILES, INC., Westlake, OH (US)

( * ) Notice: Subject to any disclaimer, the term of this patent is extended or adjusted under 35 U.S.C. 154(b) by 0 days.

(21) Appl. No.: 15/645,627

(22) Filed: Jul. 10, 2017

(65) Prior Publication Data

US 2018/0010268 A1 Jan. 11, 2018

Related U.S. Application Data

(60) Provisional application No. 62/360,059, filed on Jul. 8, 2016.

(51) Int. Cl.
*D03D 13/00* (2006.01)
*D03D 15/00* (2006.01)
*D03D 3/00* (2006.01)

(52) U.S. Cl.
CPC ..... *D03D 13/004* (2013.01); *D03D 3/005* (2013.01); *D03D 15/0033* (2013.01)

(58) Field of Classification Search
CPC ..... D03D 1/0005; D03D 5/00; D03D 15/00; D03D 1/0094; D03D 47/40; D03D 47/44; B60R 2021/23547; B60R 22/12
See application file for complete search history.

(56) References Cited

U.S. PATENT DOCUMENTS 4,600,626 A * 7/1986 Ogata ..... B60R 22/12 139/384 R
4,750,529 A * 6/1988 Watanabe ..... D03C 15/00 139/383 R
4,800,929 A * 1/1989 Watanabe ..... D03D 1/0005 139/383 R
6,419,263 B1 * 7/2002 Busgen ..... B60R 21/18 139/389
7,721,518 B2 * 5/2010 Danzey ..... B66C 1/18 57/210
2002/0067031 A1 * 6/2002 Busgen ..... B60R 21/18 280/733

OTHER PUBLICATIONS

Online website, https://www.etsy.com/listing/268717572/tactical-military-dog-collar-with-handle, reviewed on Sep. 28, 2018.

(Continued)

*Primary Examiner* — Robert H Muromoto, Jr.
(74) *Attorney, Agent, or Firm* — Calfee, Halter & Griswold LLP

(57) ABSTRACT

An exemplary webbing is formed from a plurality of warp yarns woven together with a plurality of weft yarns. The webbing extends from an outside edge to a needled edge. The outside edge is formed by the weaving of the warp yarns and weft yarns, and the needled edge is formed by the weaving of the warp yarns, weft yarns, and at least one catch cord. The warp yarns and weft yarns are dyed a first color. At least one warp yarn proximate the outside edge is dyed a second color and the at least catch cord is dyed a third color, the second and third colors being darker than the first color.

12 Claims, 22 Drawing Sheets

(56) References Cited

OTHER PUBLICATIONS

Online website, https://www.etsy.com/listing/178112956/murdock-multicam-atacs-au-atacs-fg-tan, reviewed on Sep. 28, 2018.
Online image, http://multicampattem.com/wp-content/themes/escape/images/multicamWebbingjpg, reviewed on Sep. 28, 2018.
Online website, http://multicampattem.com/multicam_raw_materials/, reviewed on Sep. 28, 2018.
Online website, http://soldiersystems.net/2016/06/01/mmi-textiles-introduces-multicam-printed-webbing/ttcomments,reviewed on Sep. 28, 2018.
Online website, http://soldiersystems.net/2012/06/03/tactical-tailor-incorporates-multicam-jacquard-webbing/, reviewed pn Sep. 28, 2018.
Online website, http://soldiersystems.net/2011/06/29/murdock-webbing-introduces-multicam-jacquard-webbing/,reviewed on Sep. 28, 2018.
Online website, https://www.etsy.com/listing/384317584/tactical-military-dog-collar-kryptek, reviewed on Sep. 28, 2018.

* cited by examiner

WEBBING WITH CONCEALED EDGES

CROSS-REFERENCE TO RELATED APPLICATIONS

The present application claims the benefit of U.S. Provisional Application Ser. No. 62/360,059, filed on Jul. 8, 2016, titled WEBBING WITH CONCEALED EDGES, the entire disclosure of which is incorporated herein by reference in its entirety.

TECHNICAL FIELD

The present application relates generally to woven webbing or fabric and in particular to narrow strips of woven webbing or fabric configured to receive a printed pattern on at least one side.

BACKGROUND OF THE INVENTION

Forming straps or tape from strips of woven webbing or fabric is known. Straps may be formed from webbing according to military specifications (e.g., MIL-W-17337, MIL-W-55301, or MIL-T-5038) for use in military applications. These straps are generally flat and can be made with a variety of widths. The webbing may include a colored pattern printed on at least one side, such as, for example, a MultiCam® camouflage pattern, to reduce visibility of the webbing when worn by military or law enforcement personnel in a combat environment. For example, the colored pattern may be printed on webbing that is uniform in color (e.g., a solid shade of Desert Sand).

SUMMARY

Exemplary embodiments of webbings are disclosed herein.

An exemplary webbing is formed from a plurality of warp yarns woven together with a plurality of weft yarns. The webbing extends from an outside edge to a needled edge. The outside edge is formed by the weaving of the warp yarns and weft yarns, and the needled edge is formed by the weaving of the warp yarns, weft yarns, and at least one catch cord. The warp yarns and weft yarns are dyed a first color. At least one warp yarn proximate the outside edge and the at least catch cord are dyed a second color that is darker than the first color.

Another exemplary webbing includes a body extending from an outside edge to a needled edge and a pattern printed on the body between the outside edge and the needled edge. The body is a first color and the outside edge and the needled edge both include a second color. The first color is lighter than the printed pattern so that the printed pattern is distinguishable from the body, and the second color is darker than the first color.

BRIEF DESCRIPTION OF THE DRAWINGS

These and other features and advantages of the present invention will become better understood with regards to the following description and accompanying drawings in which.

DETAILED DESCRIPTION

Figures 1, 2, 3, 4:
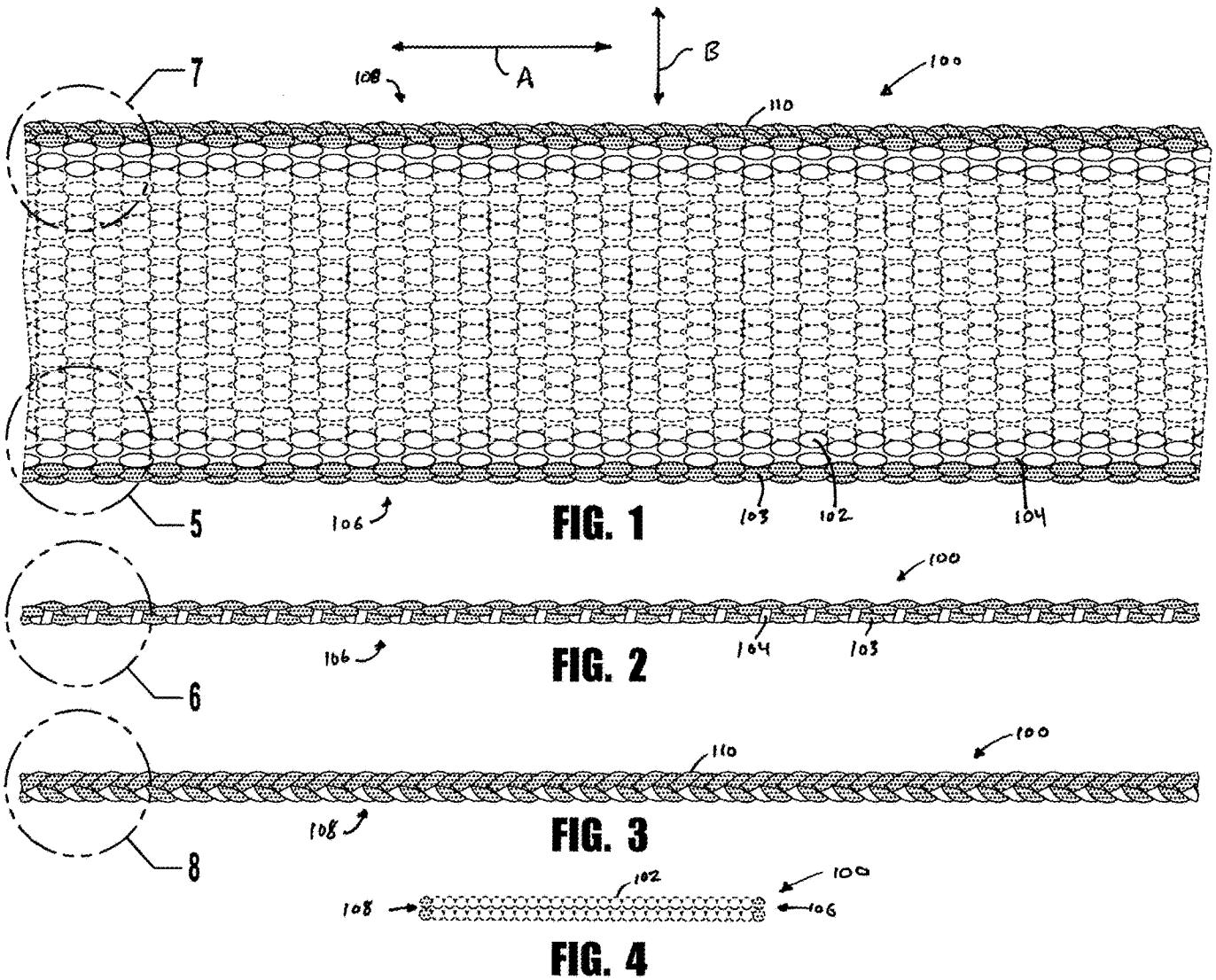
FIG. 1 is a front view of a first embodiment of a webbing segment having yarns of a contrasting color proximate an outside edge and yarns of a contrasting color proximate a needled edge, for which a back view would be a mirror image thereof.
FIG. 2 is a right side view thereof, showing the outside edge of the webbing segment of FIG. 1 having yarns of a contrasting color proximate the outside edge.
FIG. 3 is a left side view thereof, showing the needled edge of the webbing segment of FIG. 1 having yarns of a contrasting color proximate the needled edge.
FIG. 4 is a bottom view thereof, for which a top view would be a mirror image thereof.

The present disclosure merely describes exemplary embodiments of the invention and is not intended to limit the scope of the claims in any way. Indeed, the invention as claimed is broader than the exemplary embodiments, and the terms used in the claims have their full ordinary meaning, unless a limiting definition is expressly provided herein.

As described herein, when one or more components are described as being connected, joined, affixed, coupled, attached, or otherwise interconnected, such interconnection may be direct as between the components or may be indirect such as through the use of one or more intermediary components. Also as described herein, reference to a "member," "component," or "portion" shall not be limited to a single structural member, component, or element but can include an assembly of components, members, or elements. Also as described herein, the terms "substantially" and "about" are defined as at least close to (and includes) a given value or state (preferably within 10% of, more preferably within 1% of, and most preferably within 0.1% of).

Printing a pattern on the webbing allows for webbing to be made before a pattern is chosen, allowing a manufacturer to produce patterned webbing for reduced cost and in a shorter time than webbing with a woven pattern. It also allows for standardization of a printed pattern across a variety of clothing articles, such as, for example, a military standard camouflage pattern. Webbings that are intended for use with a printed pattern are typically formed of light colored yarns so that the pattern remains visible after printing. Because of the light color of the base material, areas of the webbing that are not colored with ink during the printing process may be visible to the naked eye, and/or may be visible through the use of night vision or infrared detection equipment which can be dangerous for military personnel. Under night vision, these edges may appear as white stripes that are plainly visible. These visible edges may also reduce the effectiveness of a camouflage pattern.

The present disclosure describes strips of woven webbing or fabric configured to receive a printed pattern on at least one side. The webbing may be any kind of webbing for use with a printed pattern. In some embodiments, the webbing is made to comply with military specifications, such as, for example, Mil-W-17337, Mil-W-55301, or Mil-T-5038. The webbing may be made to any length or width suitable for the application which it is intended. For example, the webbing may be about one inch wide, or about one and a half inches wide. The webbing of the present application may also be woven with any suitable fiber type and dernier, and may be formed into a strap or tape. When formed into a strap, heavier and stronger yarns are typically used when weaving the webbing to provide the requisite strength to the strap. When formed into a tape, lighter, thinner yarns are generally used. The warp and weft yarns used in the webbings of the present application generally have a diameter ranging from, for example, about 70 Denier to about 3,000 Denier.

As described herein, the "brightness" of a color refers to its value, i.e., the lightness or darkness of a color. White represents full brightness, while black represents no brightness. Thus, colors such as tan, light blue, yellow, and pastels are considered to be "light" colors, while colors such as brown, maroon, purple, and forest green are considered to be "dark" colors. Also as described herein, a first color is lighter than a second color if the first color is brighter than the second color, and vice versa.

Referring now to FIGS. 1-8, an exemplary webbing 100 is shown. The webbing 100 is woven with warp yarns 102 (also referred to as warp "ends") that run longitudinally the webbing 100 (as indicated by arrow A in FIG. 1) and weft yarns 104 (also referred to as "fill" threads) that run laterally across the webbing 100 (as indicated by arrow B in FIG. 1).

The warp and weft yarns can be woven with any weave construction, such as, for example, a plain weave, a twill weave, a 3-1 weave, or the like. The weft yarns 104 are woven across the warp yarns 102 between an outside edge 106 and a needled or knitted edge 108. Edge warp yarns 103 are the at least one, and as many as ten or more, warp yarns 102 proximate the outside edge and/or needled edges 106, 108. A catch cord 110 may be woven along the needled edge 108 to engage the weft yarns 104 to prevent the webbing 100 from unraveling. The yarn of the catch cord 110 is typically smaller relative to the warp and weft yarns, with a diameter ranging from, for example, 70 Denier to 150 Denier. In some embodiments, the edge warp yarns 103 and/or the catch cord 110 are formed of a different material than the warp and weft yarns 102, 104.

Both the warp and weft yarns 102, 104 of the webbing 100 are dyed a first color that is chosen so that a pattern printed on at least one side of the webbing 100 is visible; i.e., the first color is lighter than colors used in the printed pattern. The outside and needled edges 106, 108 of the webbing 100 include yarns dyed a second color. The second color is darker than the first color so that the edges 106, 108 are concealed. In some embodiments, one of the outside and needled edges 106, 108 includes yarns dyed the second color and the other of the outside and needled edges 106, 108 include yarns dyed a third color. The third color is also darker than the first color.

The edges 106, 108 may be a solid color, or may include a mixture of dark and light colors of yarn that provide the edges 106, 108 with a blended appearance, for example, a camouflaged edge appearance. The yarns dyed the first color may be any color that does not obscure or interfere with the pattern to be printed on the webbing 100, such as, for example, Desert Sand. The yarns dyed the second color may be any color that is darker than the first color and blends in well with the printed pattern, such as, for example, Coyote when the first color is Desert Sand. The second color may blend well with the printed pattern by being about the same brightness as the printed pattern. In some embodiments, the second color is not darker than the darkest color of the printed pattern, thereby blending the edge into the pattern. The yarns dyed the second color are disposed at the edges 106, 108 of the webbing 100 and do not hinder the print quality of the printed pattern.

Figure 5:
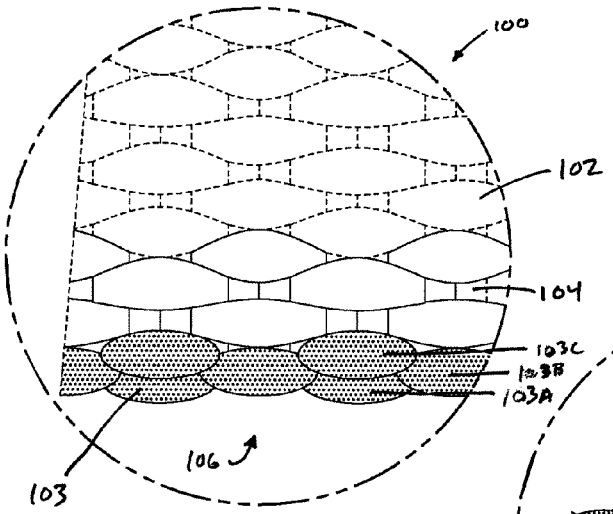
FIG. 5 is an enlarged view of section 5 of FIG. 1.
Figure 6:
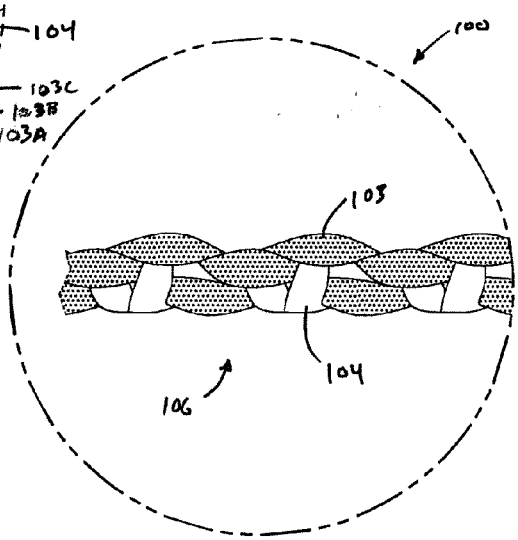
FIG. 6 is an enlarged view of section 6 of FIG. 2.

Referring now to FIG. 5, three dyed edge warp yarns 103A, 103B, 103C are shown. The dyed edge warp yarns 103A, 103B, 103C provide the outside edge 106 with a second, darker color that is periodically broken up by the weft yarns 104 dyed the first, lighter color. In some embodiments, the edge warp yarns 103 may be dyed multiple colors through a space dyeing process so that a variety of colors are spaced about longitudinally along the edge yarns 103. In some embodiments, different color fibers are used to form the edge warp yarns 103, resulting in multi-colored edge warp yarns 103. The colors used in space-dyed yarns or in multi-colored yarns may be the same or similar to colors used in a pattern printed on the webbing 100. In some embodiments, the edge warp yarns 103 include at least one, two, three, four, five, or as many as ten or even more yarns.

In some embodiments, the weft yarns 104 are dyed the second color so that the weft yarns 104 are darker in color than the warp yarns 102. Dying the weft yarns 104 a color darker than the color of the warp yarns 102 darkens the outside edge 106 relative to the rest of the webbing. When the edge warp yarns 103 are also dyed the second color, the outside edge 106 is provided with a solid color appearance. In some embodiments, the edge warp yarns 103 are dyed a third color that is also darker than the first color, and may be darker or lighter than the second color.

Figure 7:
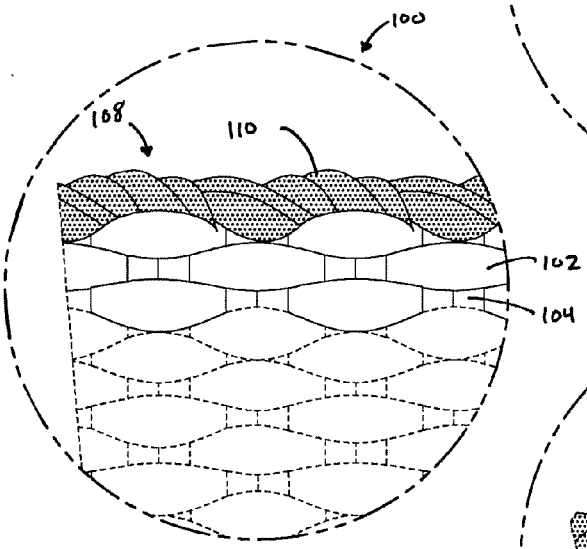
FIG. 7 is an enlarged view of section 7 of FIG. 1.
Figure 8:
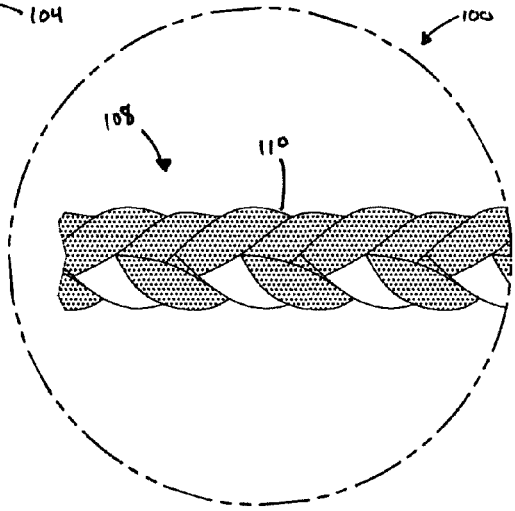
FIG. 8 is an enlarged view of section 8 of FIG. 3.
Figure 9:
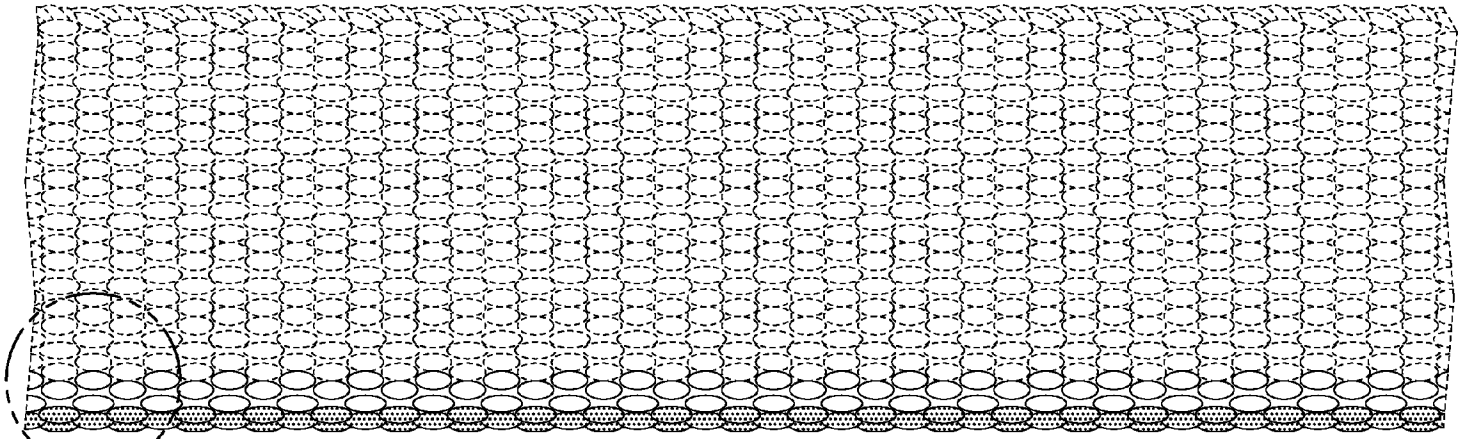
FIG. 9 is a front view of a second embodiment of a webbing segment having yarns of a contrasting color proximate an outside edge, for which a back view would be a mirror image thereof.
Figure 10:
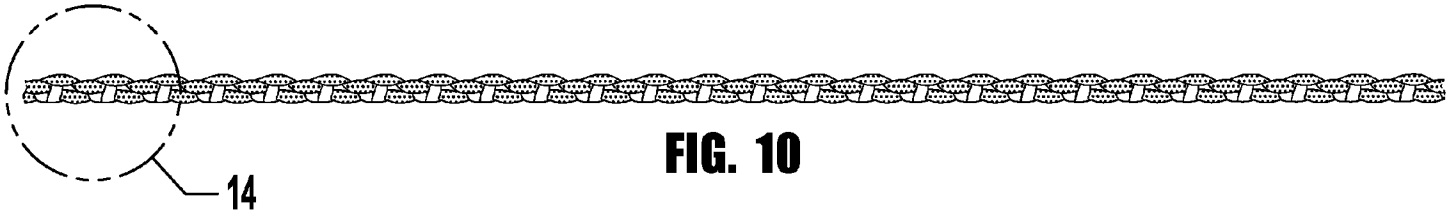
FIG. 10 is a right side view thereof, showing the outside edge of the webbing segment of FIG. 9 having yarns of a contrasting color proximate the outside edge.
Figure 11:
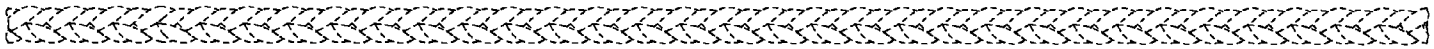
FIG. 11 is a left side view thereof, showing the needled edge of the webbing segment of FIG. 9.
Figure 12:
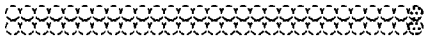
FIG. 12 is a bottom view thereof, for which a top view would be a mirror image thereof.
Figure 13:
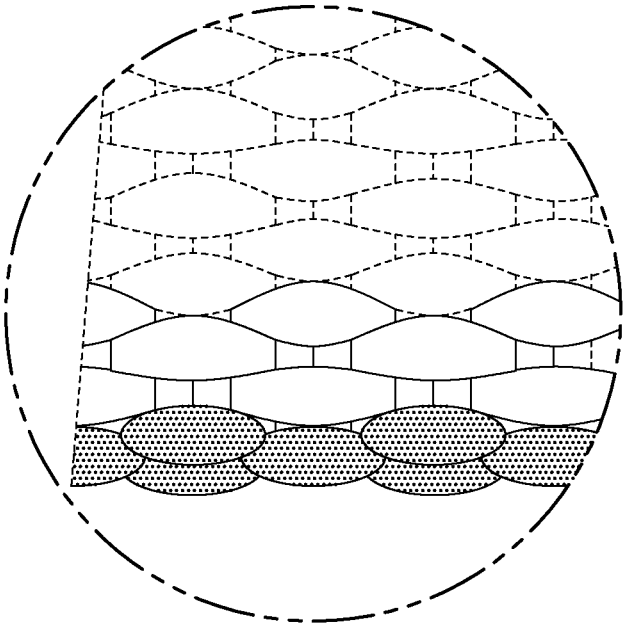
FIG. 13 is an enlarged view of section 13 of FIG. 9.
Figure 14:
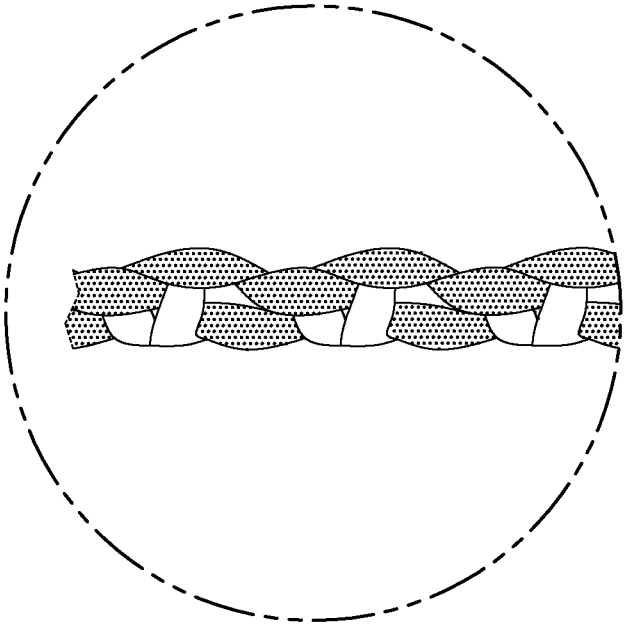
FIG. 14 is an enlarged view of section 14 of FIG. 10.
Figure 15:
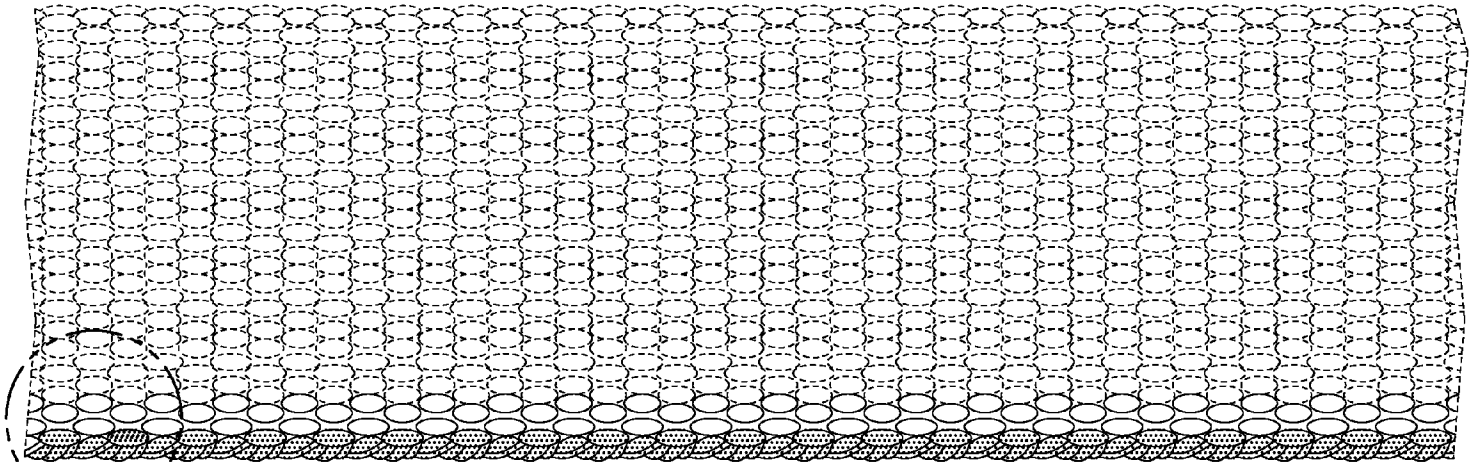
FIG. 15 is a front view of a third embodiment of a webbing segment having yarns of a contrasting color proximate a needled edge, for which a back view would be a mirror image thereof.
Figure 16:
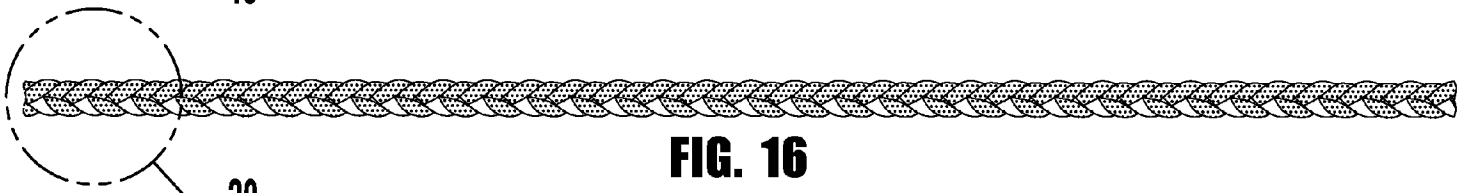
FIG. 16 is a right side view thereof, showing the needled edge of the webbing segment of FIG. 15 having yarns of a contrasting color proximate the needled edge.
Figure 17:
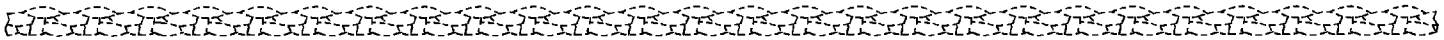
FIG. 17 is a left side view thereof, showing the outside edge of the webbing segment of FIG. 15.
Figure 18:
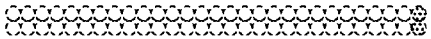
FIG. 18 is a bottom view thereof, for which a top view would be a mirror image thereof.
Figure 19:
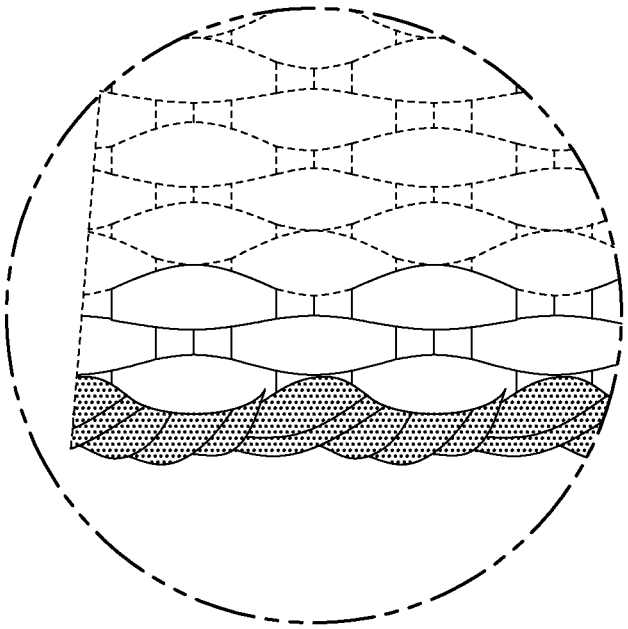
FIG. 19 is an enlarged view of section 19 of FIG. 15.
Figure 20:
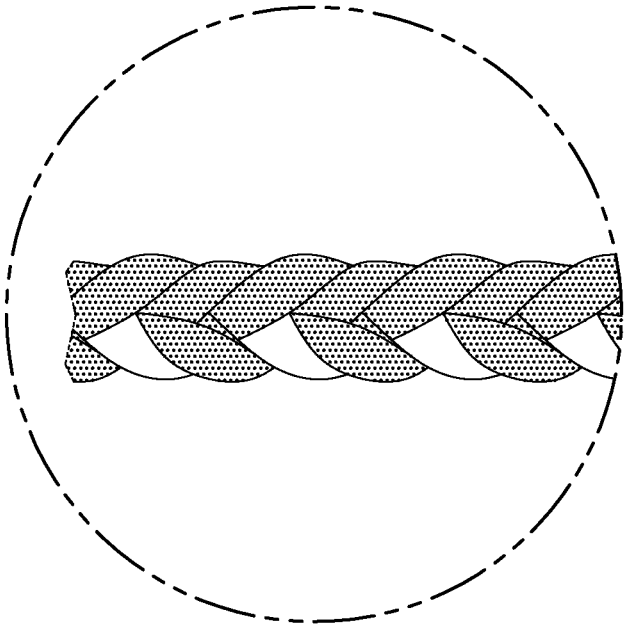
FIG. 20 is an enlarged view of section 20 of FIG. 16.
Figure 21:
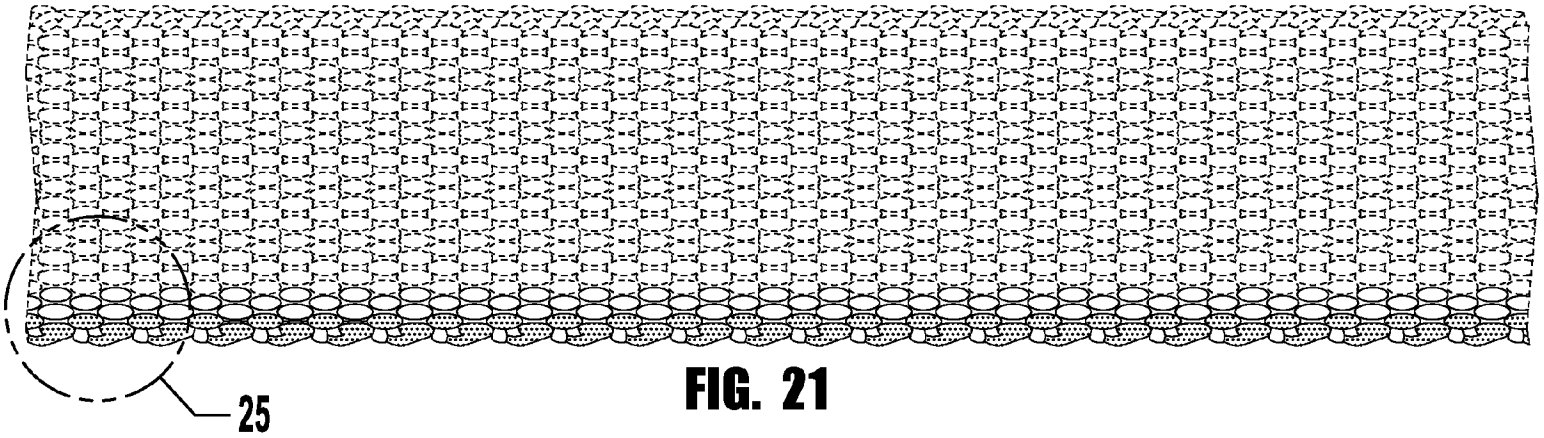
FIG. 21 is a front view of a fourth embodiment of a webbing segment having yarns of a contrasting color proximate an outside edge, for which a back view would be a mirror image thereof.
Figure 22:
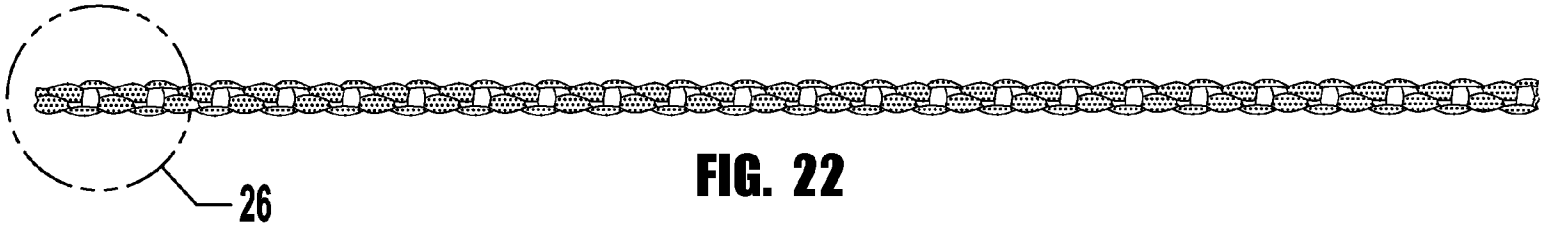
FIG. 22 is a right side view thereof, showing the outside edge of the webbing segment of FIG. 21 having yarns of a contrasting color proximate the outside edge.
Figure 23:
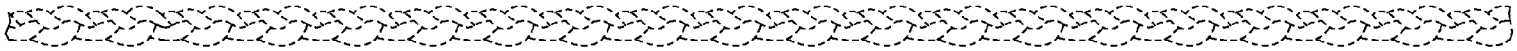
FIG. 23 is a left side view thereof, showing the needled edge of the webbing segment of FIG. 21.
Figure 24:
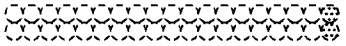
FIG. 24 is a bottom view thereof, for which a top view would be a mirror image thereof.
Figure 25:
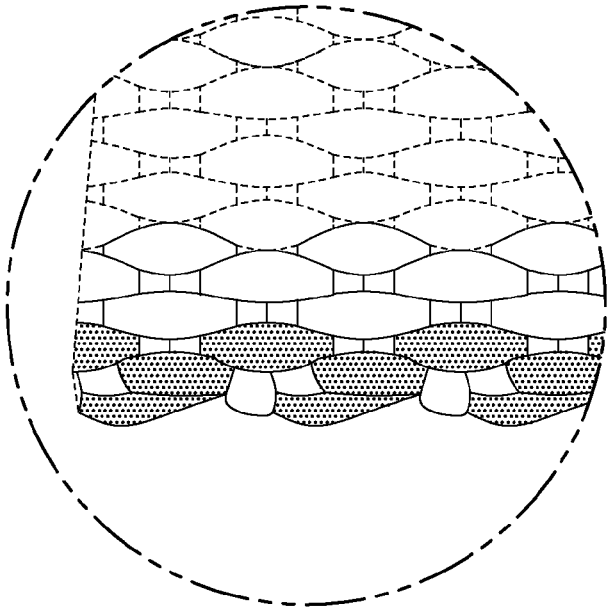
FIG. 25 is an enlarged view of section 25 of FIG. 21.
Figure 26:
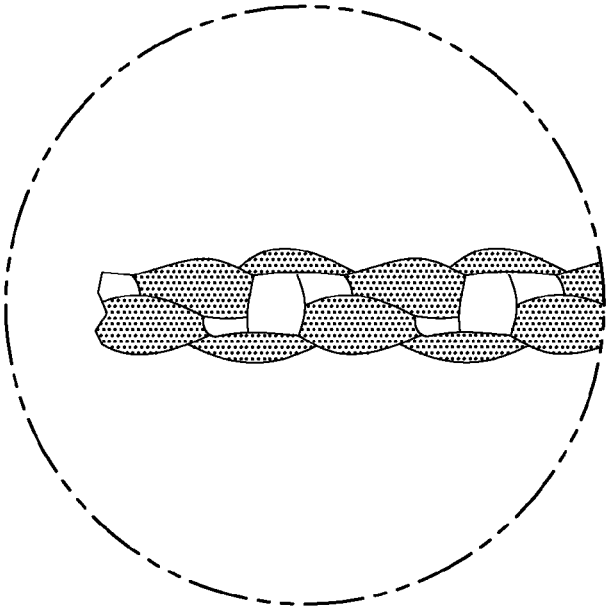
FIG. 26 is an enlarged view of section 26 of FIG. 22.
Figure 27:
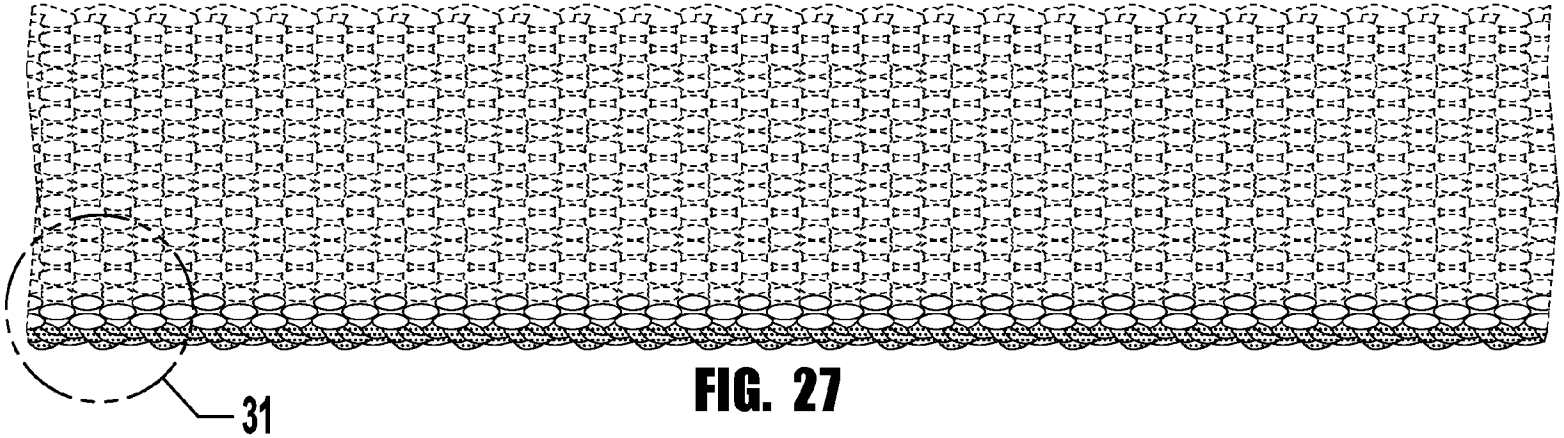
FIG. 27 is a front view of a fifth embodiment of a webbing segment having yarns of a contrasting color proximate a needled edge, for which a back view would be a mirror image thereof.
Figure 28:
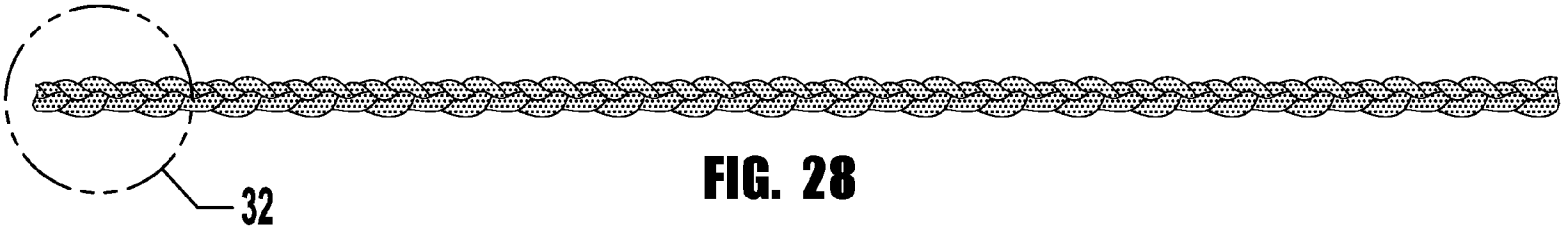
FIG. 28 is a right side view thereof, showing the needled edge of the webbing segment of FIG. 27 having yarns of a contrasting color proximate the needled edge.
Figure 29:
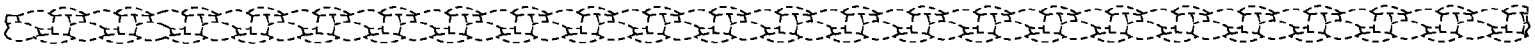
FIG. 29 is a left side view thereof, showing the outside edge of the webbing segment of FIG. 27.
Figure 30:
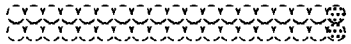
FIG. 30 is a bottom view thereof, for which a top view would be a mirror image thereof.
Figure 31:
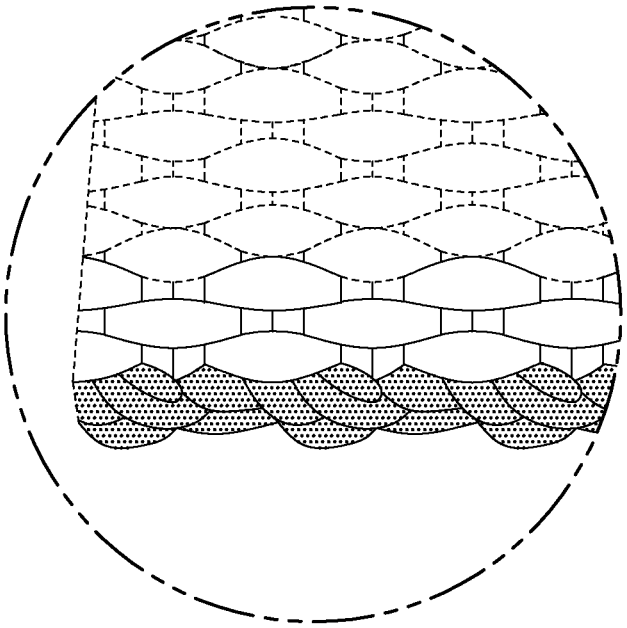
FIG. 31 is an enlarged view of section 31 of FIG. 27.
Figure 32:
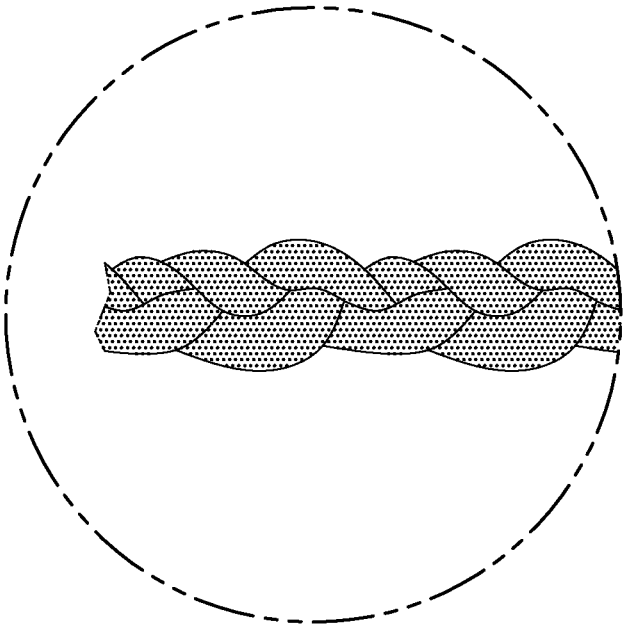
FIG. 32 is an enlarged view of section 32 of FIG. 28.
Figure 33:
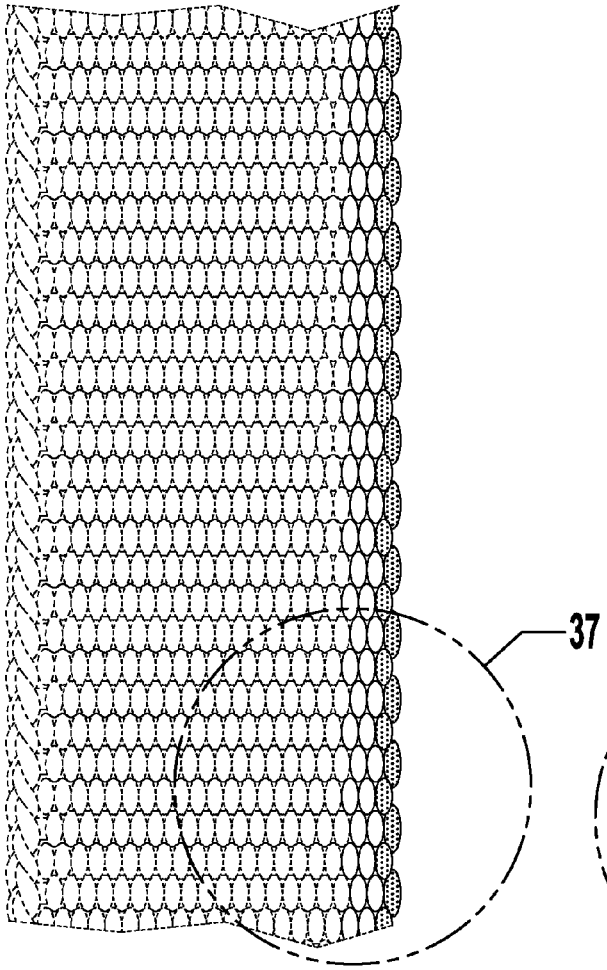
FIG. 33 is a front view of a sixth embodiment of a webbing segment having yarns of a contrasting color proximate an outside edge, for which a back view would be a mirror image thereof.
Figure 34:
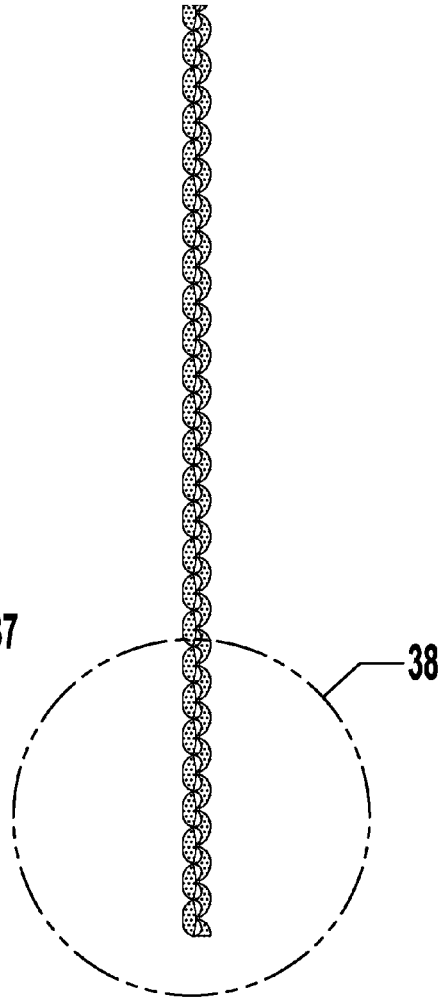
FIG. 34 is a right side view thereof, showing the outside edge of the webbing segment of FIG. 33 having yarns of a contrasting color proximate the outside edge.
Figure 35:
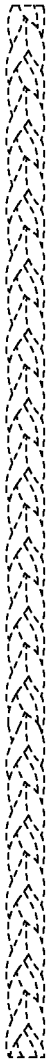
FIG. 35 is a left side view thereof, showing the needled edge of the webbing segment of FIG. 33.
Figure 36:
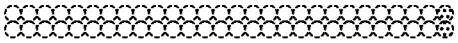
FIG. 36 is a bottom view thereof, for which a top view would be a mirror image thereof.
Figure 37:
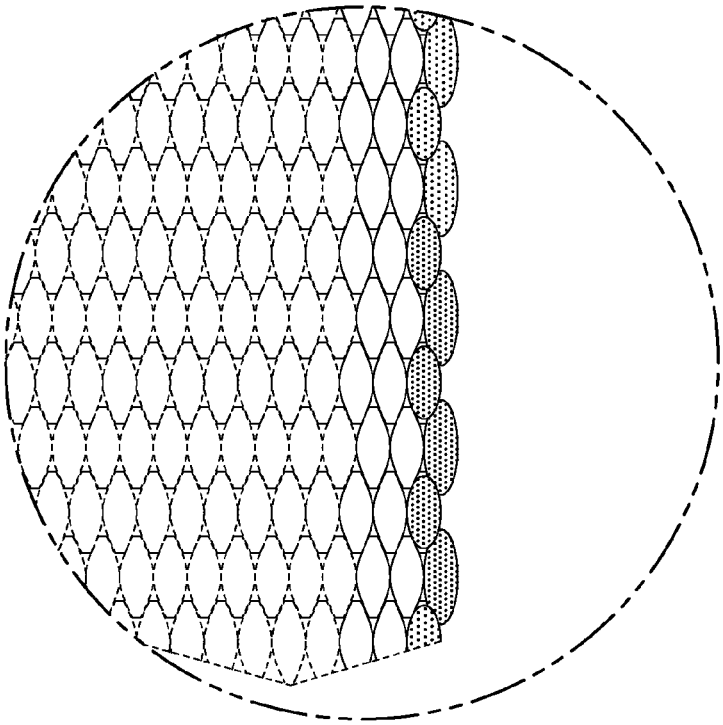
FIG. 37 is an enlarged view of section 37 of FIG. 33.
Figure 38:
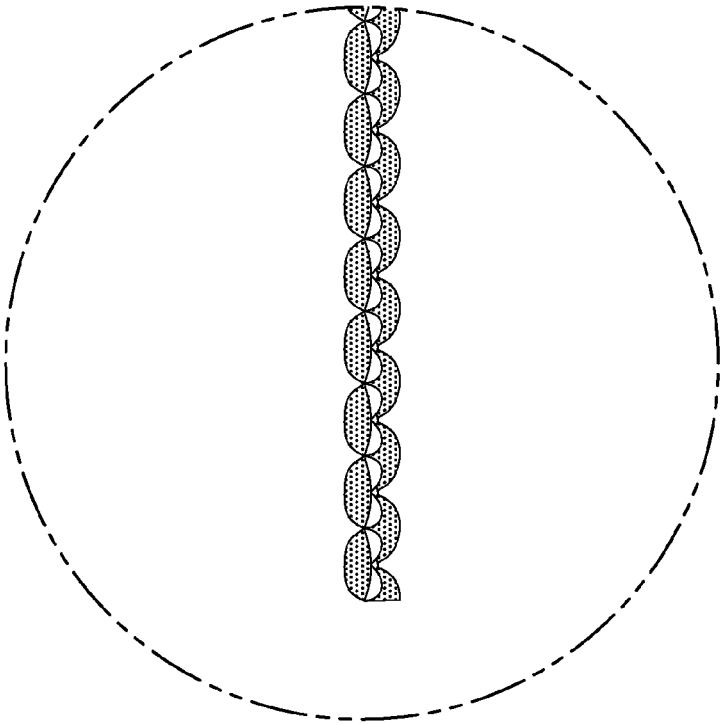
FIG. 38 is an enlarged view of section 38 of FIG. 34.
Figure 39:
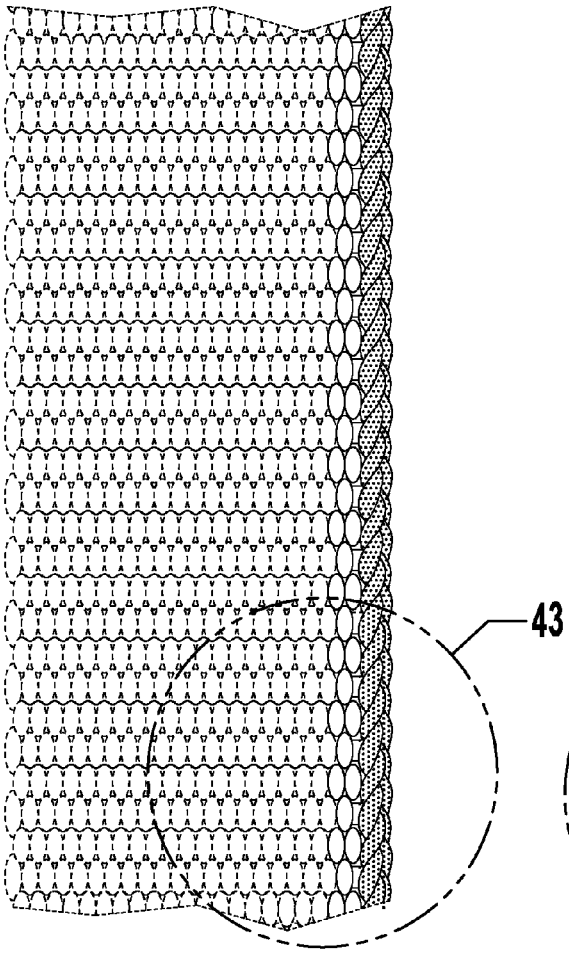
FIG. 39 is a front view of a seventh embodiment of a webbing segment having yarns of a contrasting color proximate a needled edge, for which a back view would be a mirror image thereof.
Figure 40:
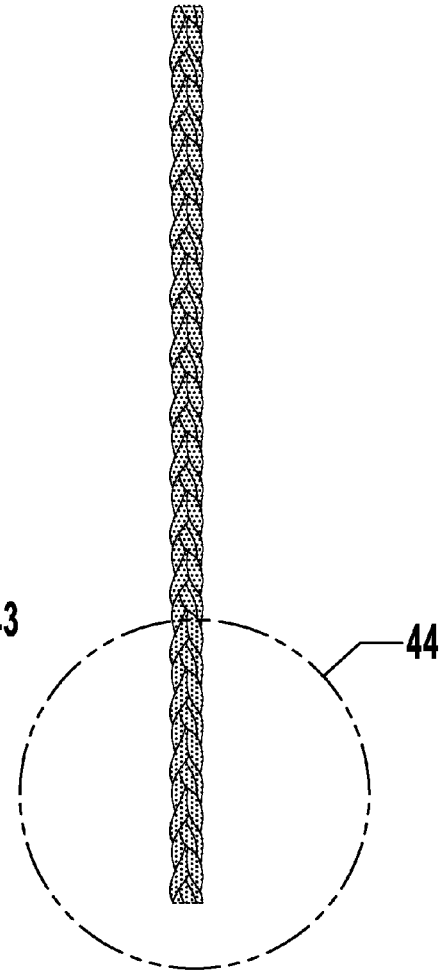
FIG. 40 is a right side view thereof, showing the needled edge of the webbing segment of FIG. 39 having yarns of a contrasting color proximate the needled edge.
Figure 41:
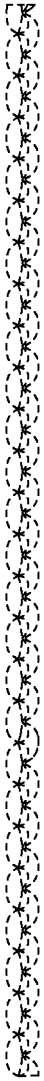
FIG. 41 is a left side view thereof, showing the outside edge of the webbing segment of FIG. 39.
Figure 42:
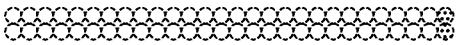
FIG. 42 is a bottom view thereof, for which a top view would be a mirror image thereof.
Figure 43:
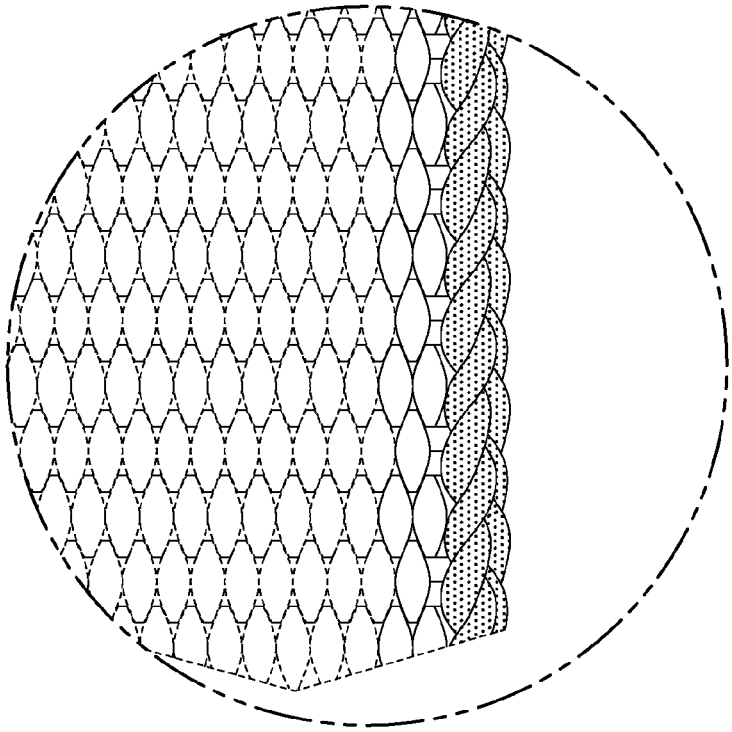
FIG. 43 is an enlarged view of section 43 of FIG. 39.
Figure 44:
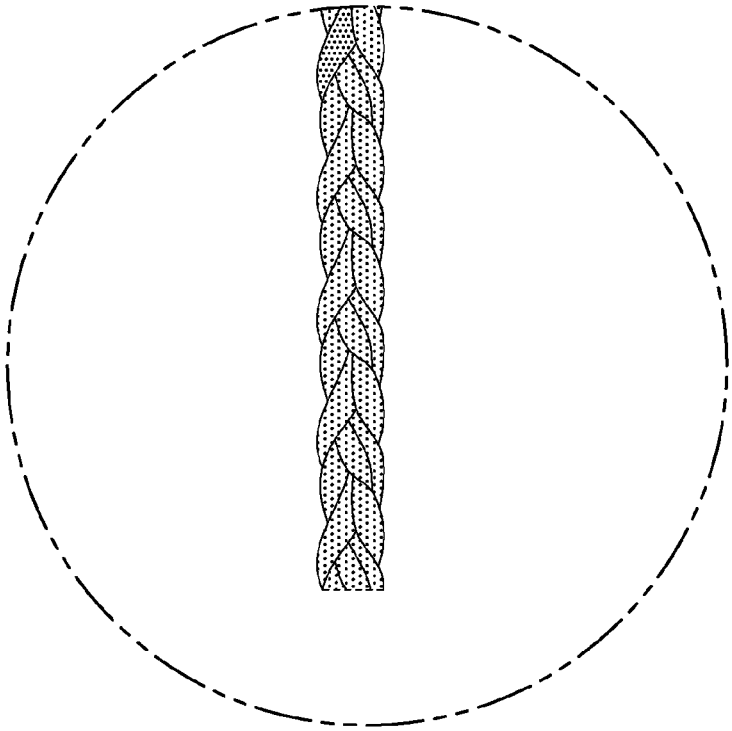
FIG. 44 is an enlarged view of section 44 of FIG. 40.
Figure 45:
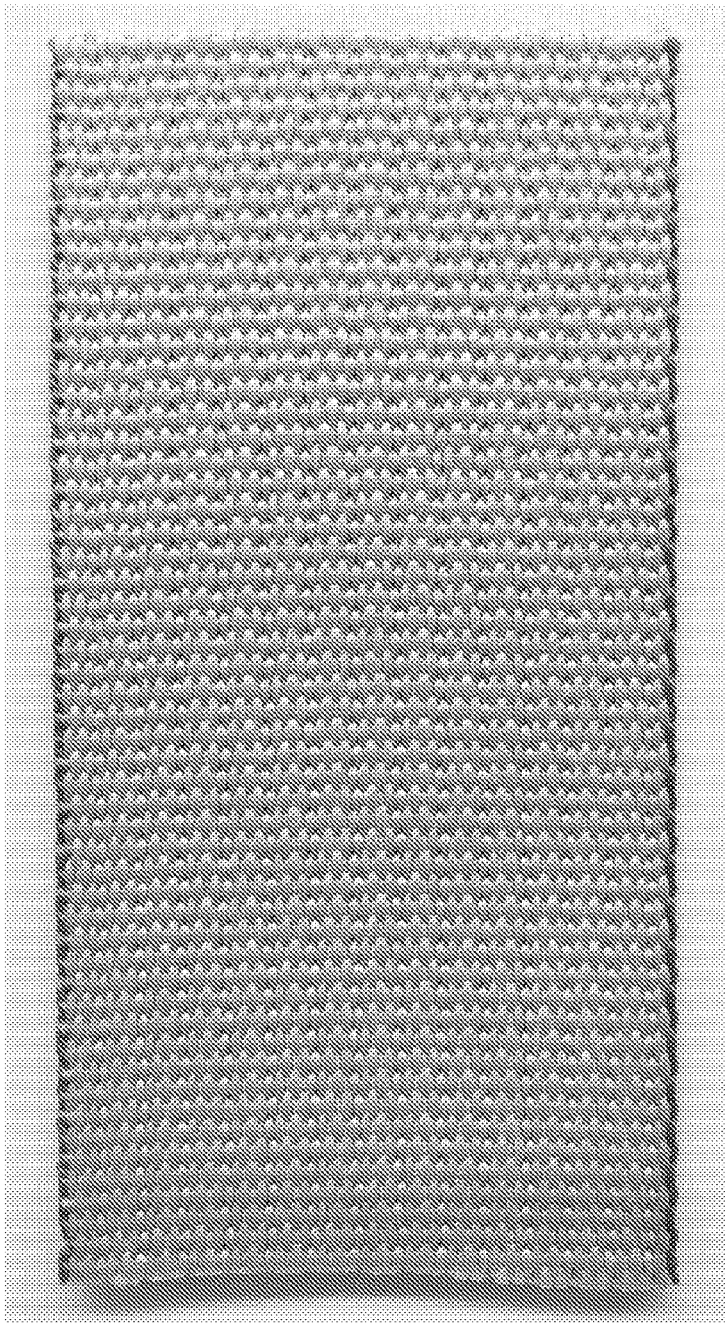
FIG. 45 is a front view photograph of an eighth embodiment of a webbing segment having yarns of a contrasting color proximate an outside edge and yarns of a contrasting color proximate a needled edge, for which a back view would be a mirror image thereof.
Figure 46:
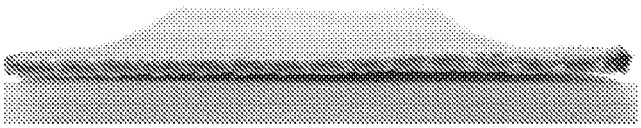
FIG. 46 is a bottom view thereof, for which a top view would be a mirror image thereof.
Figure 47:
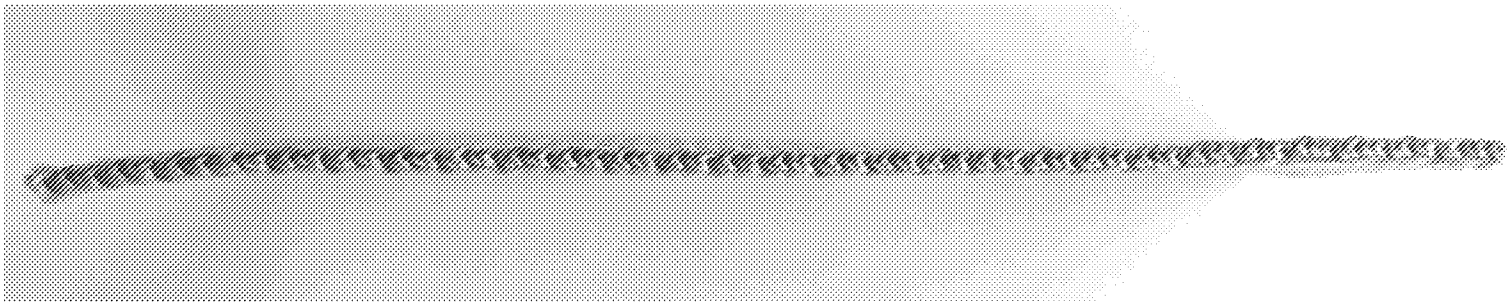
FIG. 47 is a left side photograph thereof, showing the needled edge of the webbing segment of FIG. 45 having yarns of a contrasting color proximate the needled edge.
Figure 48:
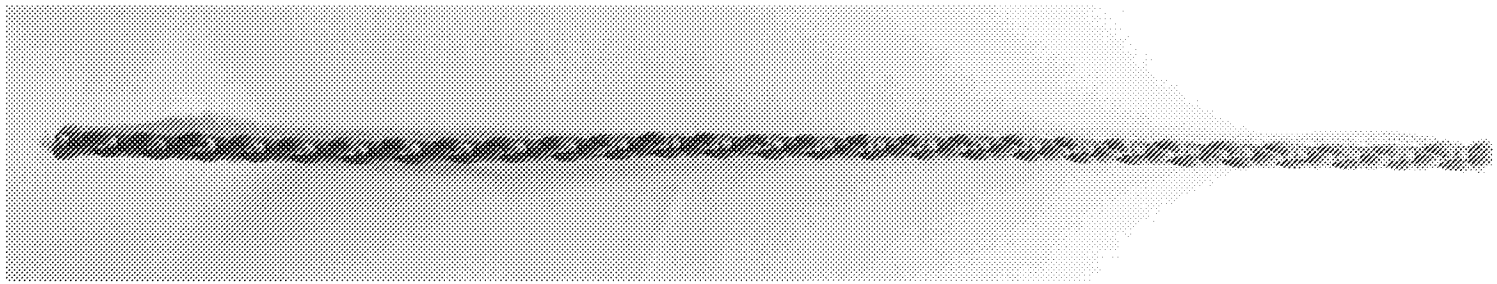
FIG. 48 is a right side photograph thereof, showing the outside edge of the webbing segment of FIG. 45 having yarns of a contrasting color proximate the outside edge.
Figure 49:
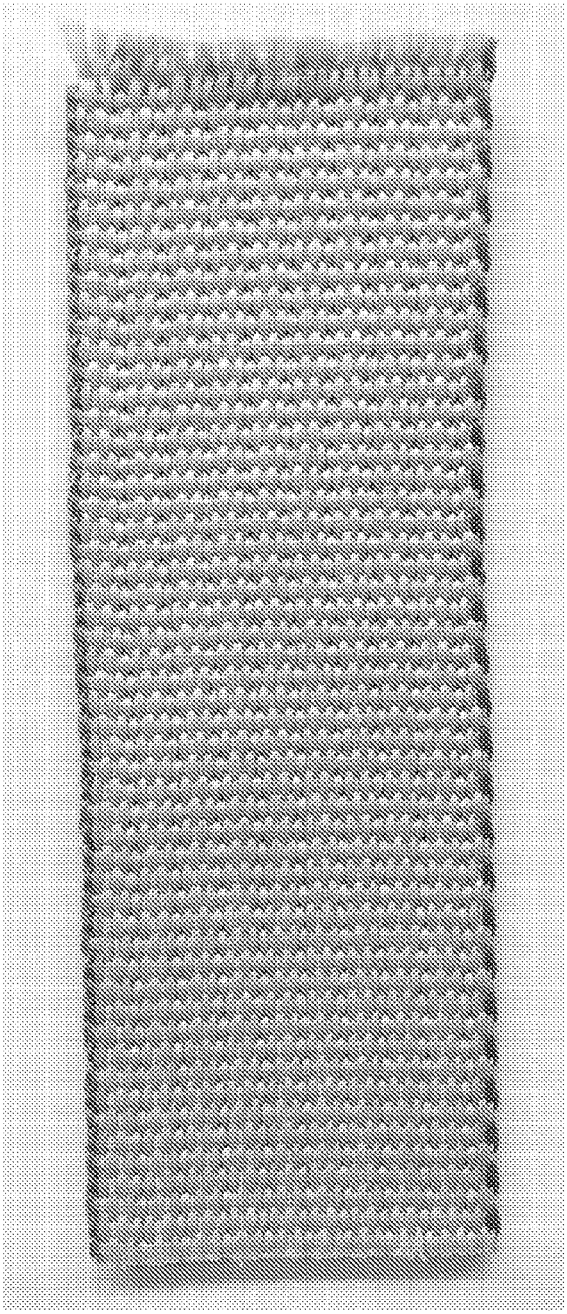
FIG. 49 is a front view photograph of a ninth embodiment of a webbing segment having yarns of a contrasting color proximate an outside edge and yarns of a contrasting color proximate a needled edge, for which a back view would be a mirror image thereof.
Figure 50:
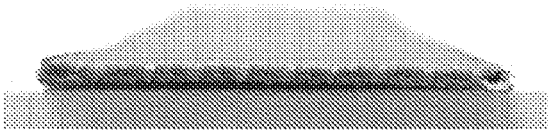
FIG. 50 is a bottom view thereof, for which a top view would be a mirror image thereof.
Figure 51:
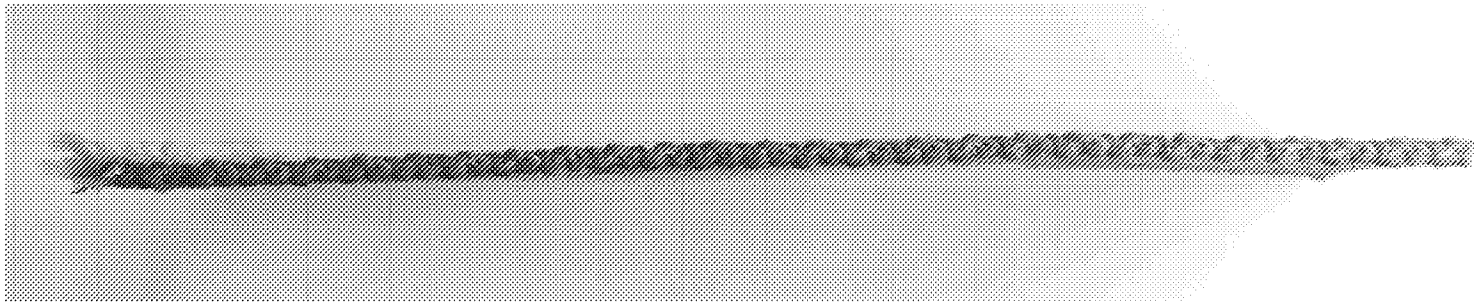
FIG. 51 is a left side photograph thereof, showing the needled edge of the webbing segment of FIG. 49 having yarns of a contrasting color proximate the needled edge.
Figure 52:
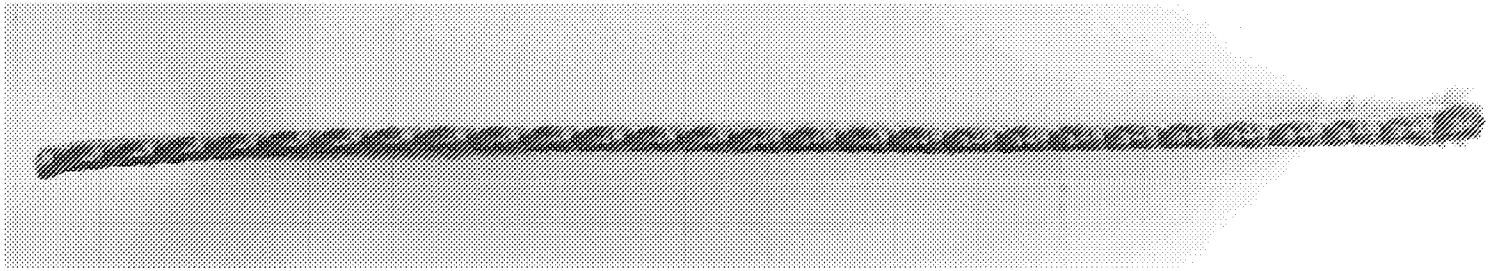
FIG. 52 is a right side photograph thereof, showing the outside edge of the webbing segment of FIG. 49 having yarns of a contrasting color proximate the outside edge.
Figure 53:
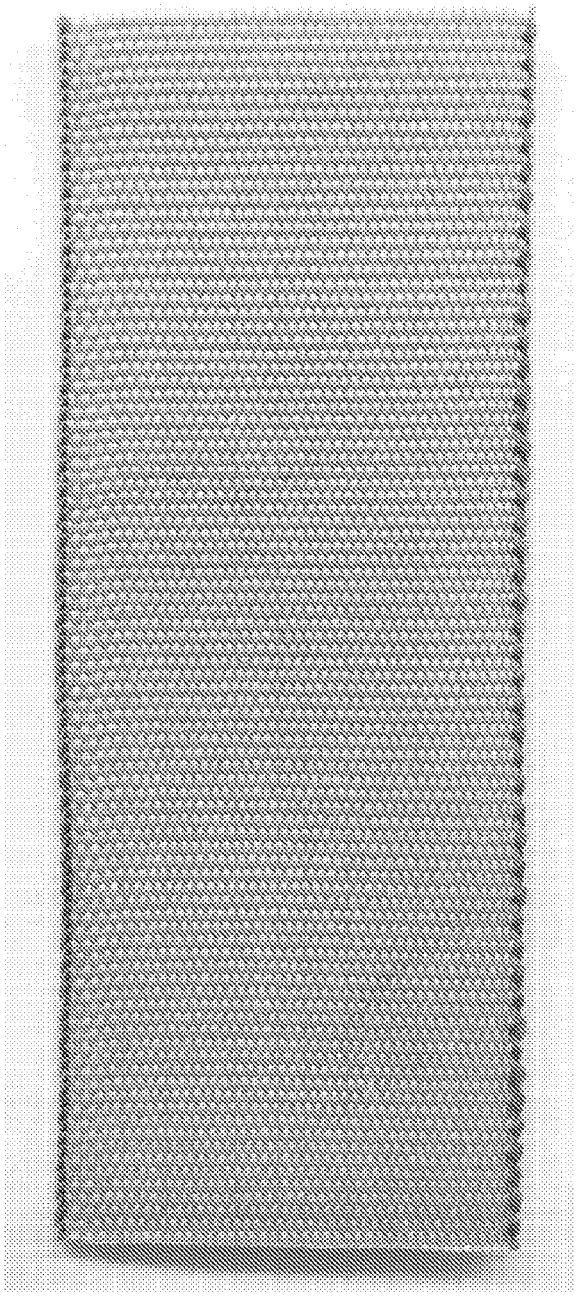
FIG. 53 is a front view photograph of a tenth embodiment of a webbing segment having yarns of a contrasting color proximate an outside edge and yarns of a contrasting color proximate a needled edge, for which a back view would be a mirror image thereof.
Figure 54:
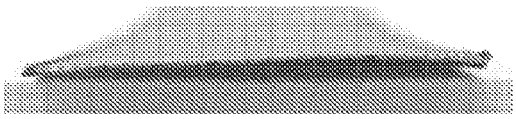
FIG. 54 is a bottom view thereof, for which a top view would be a mirror image thereof.
Figure 55:
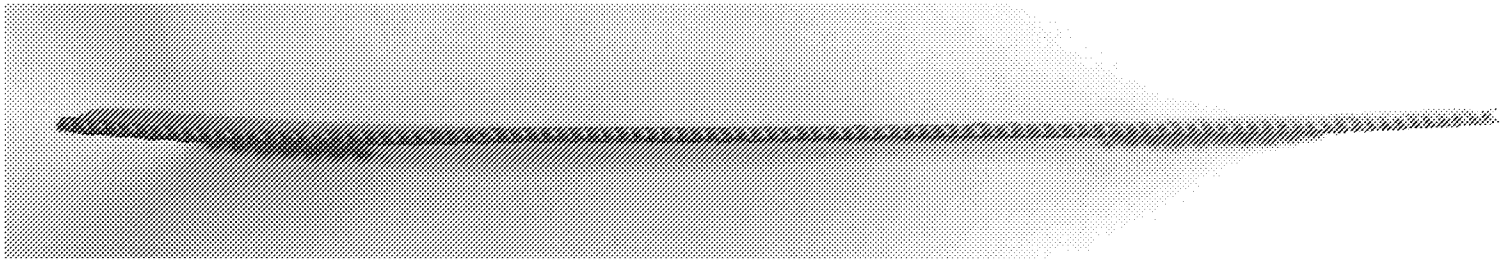
FIG. 55 is a left side photograph thereof, showing the needled edge of the webbing segment of FIG. 53 having yarns of a contrasting color proximate the needled edge.
Figure 56:
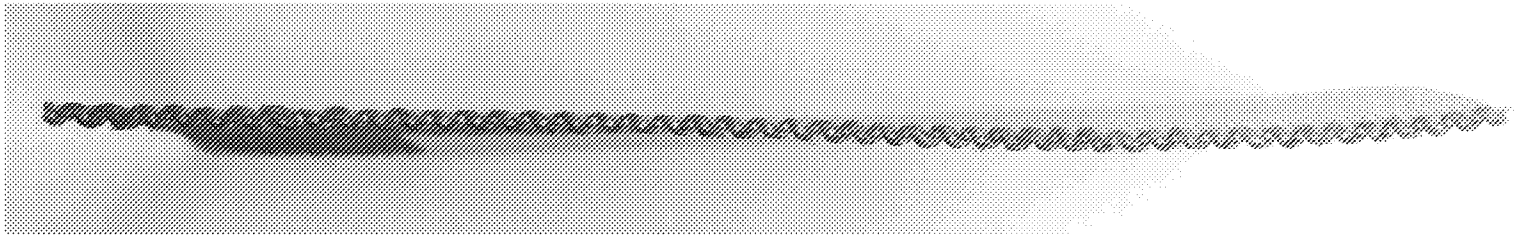
FIG. 56 is a right side photograph thereof, showing the outside edge of the webbing segment of FIG. 53 having yarns of a contrasting color proximate the outside edge.

Referring now to FIG. 7, the dyed catch cord or lockstitch yarn 110 is shown. The catch cord 110 is dyed the second color so that it is darker than the warp and weft yarns 102, 104 that are dyed the first color. The dyed catch cord 110 provides the needled edge with a second, darker color that is not broken up by weft yarns 104 dyed the first, lighter color because of the structure of the needled edge 108. In some embodiments, edge warp yarns proximate the needled edge 108 are dyed the second or third color. In some embodiments, only one of the outside and the needled edges 106, 108 includes yarns dyed the second or third color.

FIGS. 9-56 show additional embodiments of webbing with one or both edges having a darker or contrasting color. FIGS. 9-14 show a second embodiment of a webbing with an outside edge having a contrasting color. FIGS. 15-20 show a third embodiment with a needled edge having a contrasting color. FIGS. 21-26 show a fourth embodiment with an outside edge having a contrasting color. FIGS. 27-32 show a fifth embodiment with a needled edge having a contrasting color. FIGS. 33-38 show a sixth embodiment with an outside edge having a contrasting color. FIGS. 39-44 show a seventh embodiment with a needled edge having a contrasting color. FIGS. 45-48 show photographs of an eighth embodiment with outside and needled edges having a contrasting color. FIGS. 49-52 show photographs of a ninth embodiment of a webbing with outside and needled edges having a contrasting color. FIGS. 53-56 show photographs of a tenth embodiment of a webbing with outside and needled edges having a contrasting color.

While various inventive aspects, concepts and features of the disclosures may be described and illustrated herein as embodied in combination in the exemplary embodiments, these various aspects, concepts, and features may be used in many alternative embodiments, either individually or in various combinations and sub-combinations thereof. Unless expressly excluded herein all such combinations and sub-combinations are intended to be within the scope of the present application. Still further, while various alternative embodiments as to the various aspects, concepts, and features of the disclosures—such as alternative materials, structures, configurations, methods, devices, and components, alternatives as to form, fit, and function, and so on—may be described herein, such descriptions are not intended to be a complete or exhaustive list of available alternative embodiments, whether presently known or later developed. Those skilled in the art may readily adopt one or more of the inventive aspects, concepts, or features into additional embodiments and uses within the scope of the present application even if such embodiments are not expressly disclosed herein.

Additionally, even though some features, concepts, or aspects of the disclosures may be described herein as being a preferred arrangement or method, such description is not intended to suggest that such feature is required or necessary unless expressly so stated. Still further, exemplary or representative values and ranges may be included to assist in understanding the present application, however, such values and ranges are not to be construed in a limiting sense and are intended to be critical values or ranges only if so expressly stated.

Moreover, while various aspects, features and concepts may be expressly identified herein as being inventive or forming part of a disclosure, such identification is not intended to be exclusive, but rather there may be inventive aspects, concepts, and features that are fully described herein without being expressly identified as such or as part of a specific disclosure, the disclosures instead being set forth in the appended claims. Descriptions of exemplary methods or processes are not limited to inclusion of all steps as being required in all cases, nor is the order that the steps are presented to be construed as required or necessary unless expressly so stated. The words used in the claims have their full ordinary meanings and are not limited in any way by the description of the embodiments in the specification.

What is claimed is:

1. A woven webbing comprising:

a plurality of warp yarns woven together with a plurality of weft yarns to form a webbing, the webbing extending from an outside edge to a needled edge;

wherein the outside edge is formed by the weaving of the warp yarns and weft yarns;

wherein the needled edge is formed by the weaving of the warp yarns, weft yarns, and at least one catch cord;

wherein the warp yarns and weft yarns are dyed a first color;

wherein at least one warp yarn proximate the outside edge is dyed a second color;

wherein the at least catch cord is dyed a third color; and wherein the second and third colors are darker than the first color.

2. The woven webbing of claim 1, wherein the weft yarns are died a fourth color, the fourth color being darker than the first color and lighter than the second and third colors.

3. The woven webbing of claim 1, wherein the weft yarns are died a fourth color, the fourth color being darker than the first, second, and third colors.

4. The woven webbing of claim 1, wherein at least one warp yarn proximate the needled edge is dyed the third color.

5. The woven webbing of claim 1, wherein the first color is darker than the second color.

6. The woven webbing of claim 1, wherein the second and third colors are the same.

7. A woven webbing comprising:

a body extending from an outside edge to a needled edge;

a pattern printed on the body between the outside edge and the needled edge;

wherein the body is a first color;

wherein the outside edge includes a second color;

wherein the needled edge includes a third color;

wherein the first color is lighter than the printed pattern so that the printed pattern is distinguishable from the body; and wherein the second and third colors are darker than the first color.

8. The woven webbing of claim 7, wherein the second and third colors have about the same brightness as the printed pattern.

9. The woven webbing of claim 7, wherein the second and third colors do not interfere with the printed pattern.

10. The woven webbing of claim 7, wherein the second and third colors are not darker than a darkest color of the printed pattern.

11. The woven webbing of claim 7, wherein the first color is darker than the second and third colors.

12. The woven webbing of claim 7, wherein the second and third colors are the same.

* * * * *